US007690942B2

(12) United States Patent
Berg et al.

(10) Patent No.: US 7,690,942 B2
(45) Date of Patent: Apr. 6, 2010

(54) ILLUMINATED POWER RECEPTACLE

(75) Inventors: Michel J. Berg, Rochester, NY (US); Javier M. Barrantes, Rochester, NY (US); Erin M. Bruemmer, Rochester, NY (US); Igar J. Lapiczak, Rochester, NY (US); Sashank Nanduri, Rochester, NY (US)

(73) Assignee: Jemsico, LLC, Rochester, NY (US)

( * ) Notice: Subject to any disclaimer, the term of this patent is extended or adjusted under 35 U.S.C. 154(b) by 0 days.

(21) Appl. No.: 11/652,961

(22) Filed: Jan. 12, 2007

(65) Prior Publication Data

US 2007/0251712 A1 Nov. 1, 2007

Related U.S. Application Data

(60) Provisional application No. 60/761,228, filed on Jan. 23, 2006.

(51) Int. Cl.
*H01R 3/00* (2006.01)

(52) U.S. Cl. ..... 439/488

(58) Field of Classification Search ..... 439/490, 439/535, 536, 623, 488; 361/623; 362/95
See application file for complete search history.

(56) References Cited

U.S. PATENT DOCUMENTS 3,271,727 A * 9/1966 Nelson ..... 439/281
4,911,652 A * 3/1990 Savoca et al. ..... 439/282
6,078,113 A * 6/2000 True et al. ..... 307/147
6,328,584 B1 * 12/2001 Follett ..... 439/222
6,483,651 B1 * 11/2002 Maurer ..... 359/819
6,644,986 B1 * 11/2003 Wilker, Sr. ..... 439/106
6,910,920 B2 * 6/2005 Su ..... 439/606
6,945,826 B2 * 9/2005 Wise ..... 439/693
7,116,550 B2 * 10/2006 Ewing et al. ..... 361/623
7,118,248 B2 * 10/2006 Wynne Willson ..... 362/240
7,246,919 B2 * 7/2007 Porchia et al. ..... 362/276
7,447,002 B2 * 11/2008 Ewing et al. ..... 361/623

* cited by examiner

*Primary Examiner*—Neil Abrams
*Assistant Examiner*—Phuong Nguyen
(74) *Attorney, Agent, or Firm*—Hiscock & Barclay, LLP

(57) ABSTRACT

The present invention relates to the field of enhanced electrical power receptacles and associated plugs. Specifically it relates to power receptacles that are easy to identify and use. It achieves these features with a receptacle that has the individual prong-holes identified and differentiated with light source or markings in a scheme that allows the user to quickly locate and identify the proper prong-holes. The associated plug can be labeled with markings for orientation. The receptacle lighting or pattern scheme will help the user easily locate the receptacle and orient the associated plug for accurate and rapid insertion.

22 Claims, 16 Drawing Sheets

| ITEM NUMBER | PART REFERENCE | DESCRIPTION |
|---|---|---|
| 1 | 100 | CORD |
| 2 | 101 | PLUG HOUSING |
| 3 | 102 | GROUND PLUG PRONG |
| 4 | 103 | HOT PLUG PRONG |
| 5 | 104 | NEUTRAL PLUG PRONG |
| 6 | 105 | OVERRIDE SWITCH |
| 7 | 106 | RECEPTACLE (OUTLET) |
| 8 | 107 | COLOR OR PATTERN 1 FOR GROUND PRONG-HOLE |
| 9 | 108 | COLOR OR PATTERN 2 FOR HOT PRONG-HOLE |
| 10 | 109 | COLOR OR PATTERN 3 FOR NEUTRAL PRONG-HOLE |
| 11 | 110 | COLOR OR PATTERN 4 FACE OR SIDE LIGHT |
| 12 | 111 | GROUND PRONG-HOLE |
| 13 | 112 | HOT PRONG-HOLE |
| 14 | 113 | NEUTRAL PRONG-HOLE |
| 15 | 114 | ADAPTER GROUND PRONG |
| 16 | 115 | ADAPTER HOT PRONG |
| 17 | 116 | ADAPTER NEUTRAL PRONG |
| 18 | 117 | GROUND |
| 19 | 118 | AC HOT |
| 20 | 119 | AC NEUTRAL |
| 21 | 120 | LID |
| 22 | 121 | FILTER FOR COLOR 1 |
| 23 | 122 | FILTER FOR COLOR 2 |
| 24 | 123 | FILTER FOR COLOR 3 |
| 25 | 124 | FILTER FOR COLOR 4 |
| 26 | 125 | ADAPTER ENCLOSURE |
| 27 | 126 | COLOR OR PATTERN 1 FOR GROUND PRONG |
| 28 | 127 | COLOR OR PATTERN 2 FOR HOT PRONG |

FIG. 1A

| ITEM NUMBER | PART REFERENCE | DESCRIPTION |
|---|---|---|
| 29 | 128 | COLOR OR PATTERN 3 FOR NEUTRAL PRONG |
| 30 | 129 | BACKLIGHT ENCLOSURE |
| 31 | 130 | ELEVATION/DEPRESSION MARKINGS FOR GROUND PRONG-HOLE |
| 32 | 131 | ELEVATION/DEPRESSION MARKINGS FOR HOT PRONG-HOLE |
| 33 | 132 | ELEVATION/DEPRESSION MARKINGS FOR NEUTRAL PRONG-HOLE |
| 34 | 133 | ELEVATION/DEPRESSION MARKINGS FOR GROUND PRONG |
| 35 | 134 | ELEVATION/DEPRESSION MARKINGS FOR HOT PRONG |
| 36 | 135 | ELEVATION/DEPRESSION MARKINGS FOR NEUTRAL PRONG |
| 37 | 136 | ADJACENT LIGHTING FOR GROUND PRONG-HOLE |
| 38 | 137 | ADJACENT LIGHTING FOR HOT PRONG-HOLE |
| 39 | 138 | ADJACENT LIGHTING FOR NEUTRAL PRONG-HOLE |
| 40 | 139 | ADJACENT MARKING FOR GROUND PLUG PRONG |
| 41 | 140 | ADJACENT MARKING FOR HOT PLUG PRONG |
| 42 | 141 | ADJACENT MARKING FOR NEUTRAL PLUG PRONG |
| 43 | 142 | POWER SOURCE |

FIG. 1B

ILLUMINATED POWER RECEPTACLE

This application claims the benefit of U.S. Provisional Patent Application Ser. No. 60/761,228, filed Jan. 23, 2006, which is hereby incorporated by reference in its entirety.

FIELD OF THE INVENTION

This invention relates to an enhanced receptacle using a lighting or marking scheme to aid the user in locating the receptacle and with proper plug insertion.

BACKGROUND OF THE INVENTION

Plugging electrified objects into receptacles is an everyday occurrence. Polarized plugs and the small size of plugs, often makes locating the receptacle and orienting the plug difficult. This is particularly true for people with low vision and the vast majority of the middle-aged and elderly people with presbyopia. Additionally, people who are blind have difficulty locating receptacles and orienting plugs. Low vision is defined as vision that is impaired and cannot be corrected by way of surgery, glasses, or contacts. Presbyopia is a visual condition that develops in most middle-aged people in which loss of elasticity of the lens of the eye causes inability to focus sharply on near objects (often corrected by reading glasses that may not be readily available during the process of plug insertion). The process of locating a receptacle and orienting and inserting the plug can be frustrating especially for people with impaired vision. Impaired vision includes people with presbyopia, myopia, hyperopia, and low vision such as caused by amblyopia, and scotoma, and who are blind. The Illuminated Power Receptacle is designed to decrease the frustration of this task especially for impaired vision users.

To aid in proper plug insertion, we disclose differentiating the prong-holes on the receptacle with lighting or markings. The lighting or markings can be color coded. Additionally the plug prongs can be identified with markings, to match the prong-holes on the receptacle. One embodiment is for the receptacle to have the hot prong-hole illuminated with red light and the neutral prong-hole illuminated with yellow light. Correspondingly the plug has a red mark on the hot prong side of the plug housing and a yellow mark on the neutral prong side. These features should help a human orient and properly insert a plug accurately and rapidly.

U.S. Pat. No. 6,078,113 issued to True, et al. on Jun. 20, 2000 discloses a power socket with illuminated interior areas of each plug blade slot (prong-holes) using colored diodes with a first color for illuminating the neutral plug blade slot and a second color for the hot plug blade slot. Illumination of the prong-holes from the interior is distinct from illuminating or otherwise marking the prong-holes from the exterior or face of a receptacle. Interior prong-hole lighting may not project well through the prong-holes, especially when the receptacle is viewed from an angle as is commonly done and thus may not provide the user with adequate information to efficiently orient the plug. Additionally, this invention does not disclose labeling the associated plug. The current invention, claimed within this document, specifies that the receptacle prong-holes be distinguished, either by local lighting or specific patterns or colors on the surface to assist with rapid orientation of the plug. The type of lighting disclosed in the current invention should be visible from most viewing angles and is distinct from internal prong-hole lighting with color diodes.

U.S. Pat. No. 6,089,893 issued to Yu, et al. on Jul. 18, 2000 discloses an illuminated electrical receptacle employing an electroluminescent light to illuminate the entire face of the receptacle. It is designed to light the entire receptacle, but without regard to further distinguishing the different receptacle holes, except as achievable by conventional ambient lighting. U.S. Pat. No. 6,547,411 issued to Dombusch on Apr. 15, 2003 discloses an illuminated outlet that illuminates a surrounding area to allow visibility at night. This invention relates to night lights. Neither of these inventions discloses using different colored lights, marks, or patterns, or of labeling the associated plug, indicating that plug orientation was not the object of these inventions. The current invention, claimed within this document, specifies that the receptacle prong-holes be distinguished, either by local lighting or specific patterns or colors to assist with rapid orientation of the plug.

U.S. Pat. No. 6,109,760 issued to Salatrik, et al. on Aug. 29, 2000 discloses an illuminated power outlet assembly for a motor vehicle using a light emitting diode positioned within a power outlet, specifically between the casing and the insulator, such that when the illumination device illuminates, the light passes through the insulator to light the power outlet. This invention is specific to a single outlet hole and makes no disclosure relevant to assisting with plug orientation.

U.S. Pat. No. 6,183,101 issued to Chien on Feb. 6, 2001 describes a cover incorporating electroluminescent lighting elements to serve as a night light or for decorative purposes. This invention specifies that the cover is a wall plate, a switch cover, an electrical outlet cover, a cable outlet cover, a dimmer switch cover, a timer cover, and a keyboard fascia plate. Similarly, U.S. Pat. No. 5,683,166 issued to Lutzker on Nov. 4, 1997 discloses an electroluminescent wall plate. In the current invention, the lighting is integrated into the receptacle. Furthermore, the purpose of the lighting in the current invention is to aid in locating the receptacle and to guide the orientation for proper plug insertion not as a night light or decoration. In addition, the current receptacle system discloses use of the lighting in color or pattern combinations associated with the prong-holes in the receptacle and plug to guide the user in proper plug insertion.

U.S. Pat. No. 5,662,408 issued to Marischen on Sep. 2, 1997 discloses a night light having conductors for connecting to an electrical supply. This invention is a plug in device.

Thus there is a need in the art for a receptacle with visual or tactile components to assist in locating the receptacle and assist with orientation to aid users.

REFERENCES CITED

U.S. patent Documents

| U.S. Patent Documents | | | |
|---|---|---|---|
| D464,865 S | October 2002 | Luu | D8/353 |
| 5,816,682 | October 1998 | Marischen | 362/84 |
| 6,906,617 | June 2005 | Meulen et al | 340/310.01 |
| 6,183,264 B1 | February 2001 | Harsányi | 439/38 |
| 6,907,278 B2 | June 2005 | Herle | 455/572 |
| 4,915,639 | April 1990 | Cohn et al | 439/188 |
| 6,552,888 | April 2003 | Weinberger | 361/57 |
| 6,894,221 | May 2005 | Gorman | 174/53 |
| 6,537,089 | March 2003 | Montague | 439/145 |
| 6,455,789 | September 2002 | Allison | 200/51.09 |
| 5,113,045 | May 1991 | Crofton | 200/51.09 |
| 4,846,707 | July 1989 | Pirkle | 439/142 |
| 3,990,758 | November 1976 | Petterson | 439/138 |
| 5,662,408 | September 1997 | Marischen | 362/641 |
| 6,183,101 | February 2001 | Chien | 362/84 |

-continued

| U.S. Patent Documents | | | |
|---|---|---|---|
| 5,910,776 | June 1999 | Black | 340/10.1 |
| 6,229,107 | May 2001 | Flint et al | 200/51.09 |
| 6,717,077 | April 2004 | Chevarie et al | 200/51.09 |
| 4,591,732 | May 1986 | Neuenschwander | 307/140 |
| 6,078,113 | June 2000 | True et al | 307/147 |
| 6,089,893 | July 2000 | Yu et al | 439/225 |
| 6,547,411 | April 2003 | Dornbusch | 362/95 |
| 6,109,760 | August 2000 | Salatrik | 362/95 |
| 6,183,101 | February 2001 | Chien | 362/84 |
| 5,683,166 | November 1997 | Lutzker | 362/84 |

SUMMARY OF THE INVENTION

Standard receptacles have the simple task of providing power to a standard plug. An enhanced power outlet system will additionally allow the user to easily locate and identify the receptacle and orient the plug for accurate and rapid insertion. Objects and advantages of the illuminated power receptacle system include incorporating visual or tactical means to aid the user in locating and inserting plugs into receptacles to assist people with impaired vision, decreasing frustration, improving time utilization, and potentially decreasing risk of accidental electrocution. The population assisted by this device is large and includes people with presbyopia, myopia, hyperopia, amblyopia, and scotoma, and who are blind.

It is therefore an object of the present invention to provide an external electrical receptacle that can be plugged into an existing standard outlet with the individual prong-holes identified with different colors of illumination.

A further object of the present invention is to provide an external electrical receptacle that can be plugged into an existing standard outlet with the individual prong-holes identified with different marking patterns.

Another object of the present invention is to provide an internal electrical receptacle with the individual prong-holes identified with different colors of illumination.

A further object of the present invention is to provide an internal electrical receptacle with the individual prong-holes identified with different marking patterns.

It is yet another object of the present invention to provide plugs with external markings in the form of patterns, colors, or elevations/depressions to identify the individual prongs.

Further objects and advantages will become apparent from a consideration of the ensuing description and drawings.

BRIEF DESCRIPTION OF THE DRAWINGS

FIG. 1A and FIG. 1B is a table of reference numbers listed in FIGS. 2 through 15.

DETAILED DESCRIPTION OF THE INVENTION

Figure 2:
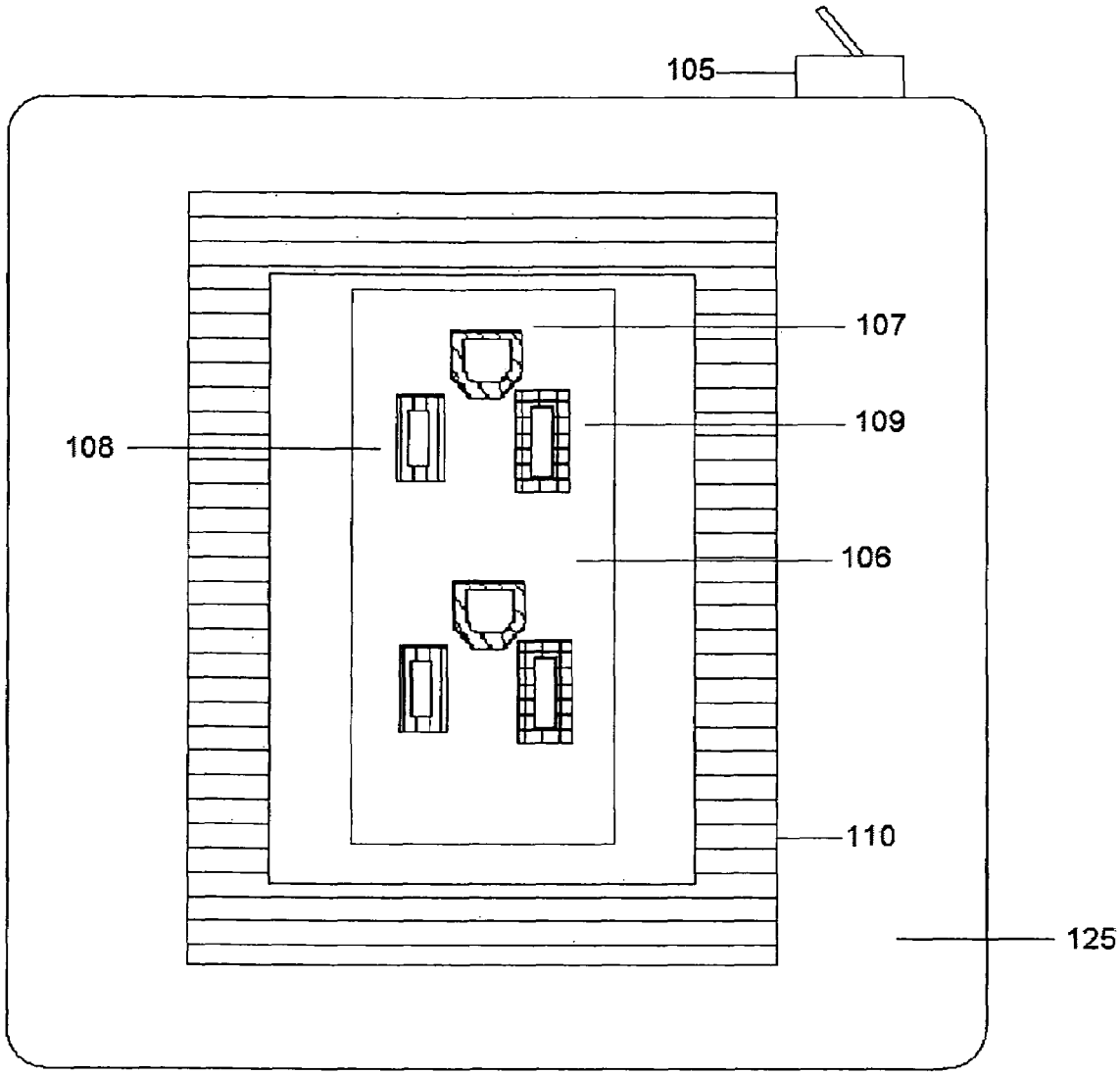
FIG. 2 is a front view of the Illuminated Power Receptacle with surrounding color lighting identifying the prong-holes. This view may be of either an external (as in FIG. 13) or internal wall receptacle.

Referring now to the drawings, FIG. 1A and FIG. 1B contain a table of the descriptions of the designators for FIG. 2 through FIG. 15.

FIG. 2 is a front view of an embodiment of the Illuminated Power Receptacle with color lighting surrounding the prong-holes. The enclosure 125 contains a duplex receptacle 106. Regions 107, 108 and 109 represent the lighting scheme surrounding the prong-holes. The duplex receptacle 106 has a face lighting scheme and marking pattern 110. The lighting scheme has an on/off switch 105. This view may be of either an external (as in FIG. 13) or internal wall receptacle.

Figure 3:
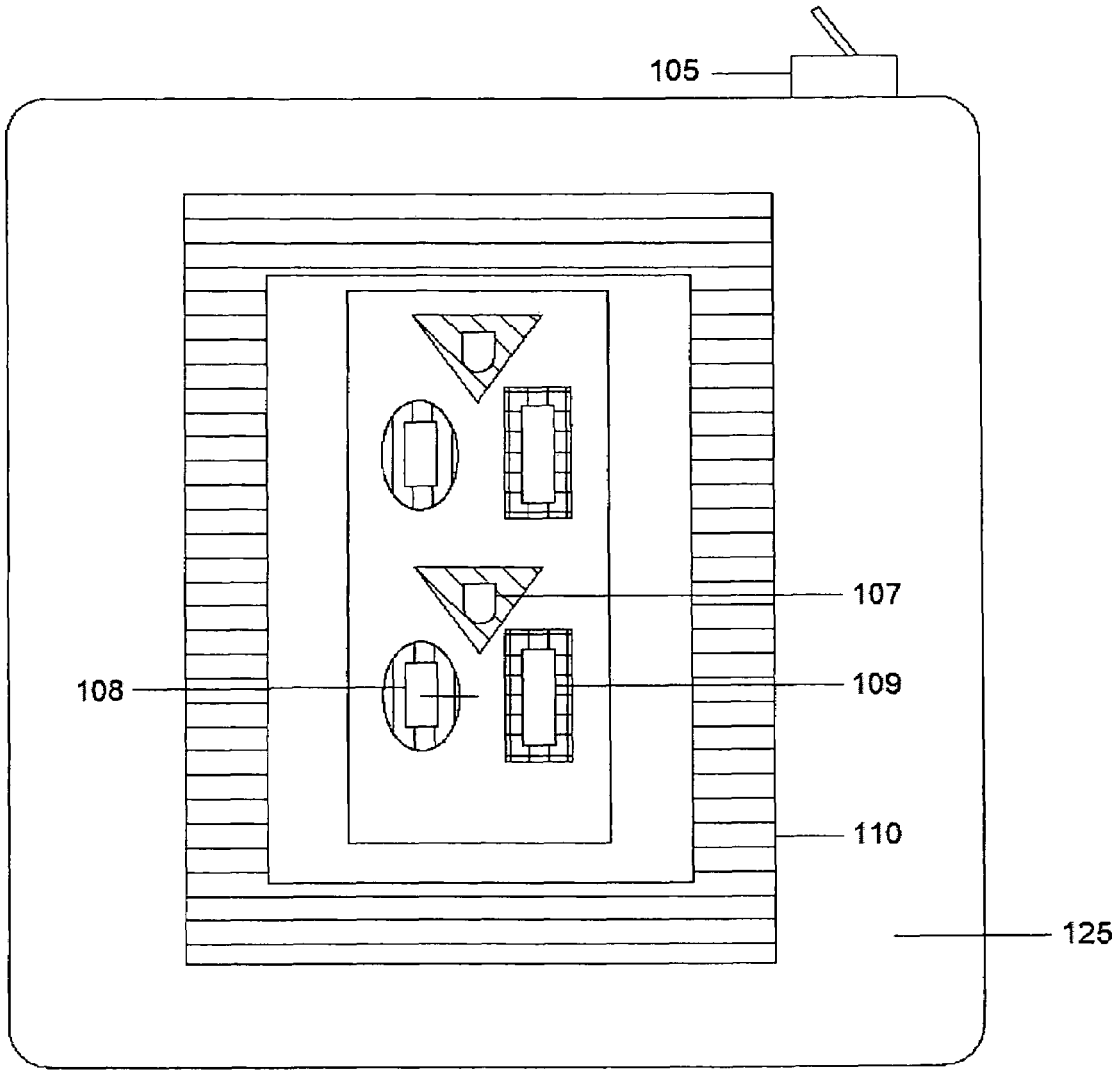
FIG. 3 is a front view of the Illuminated Power Receptacle with surrounding color markings identifying the prong-holes. This view may be of either an external (as in FIG. 13) or internal wall receptacle.

FIG. 3 is a front view of an embodiment of the Illuminated Power Receptacle with color markings surrounding the prong-holes. The enclosure 125 contains regions 107, 108 and 109 that represent the marking scheme around the prong-holes. It also contains the face lighting scheme and marking pattern 110. This view may be of either an external (as in FIG. 13) or internal wall receptacle.

Figure 4:
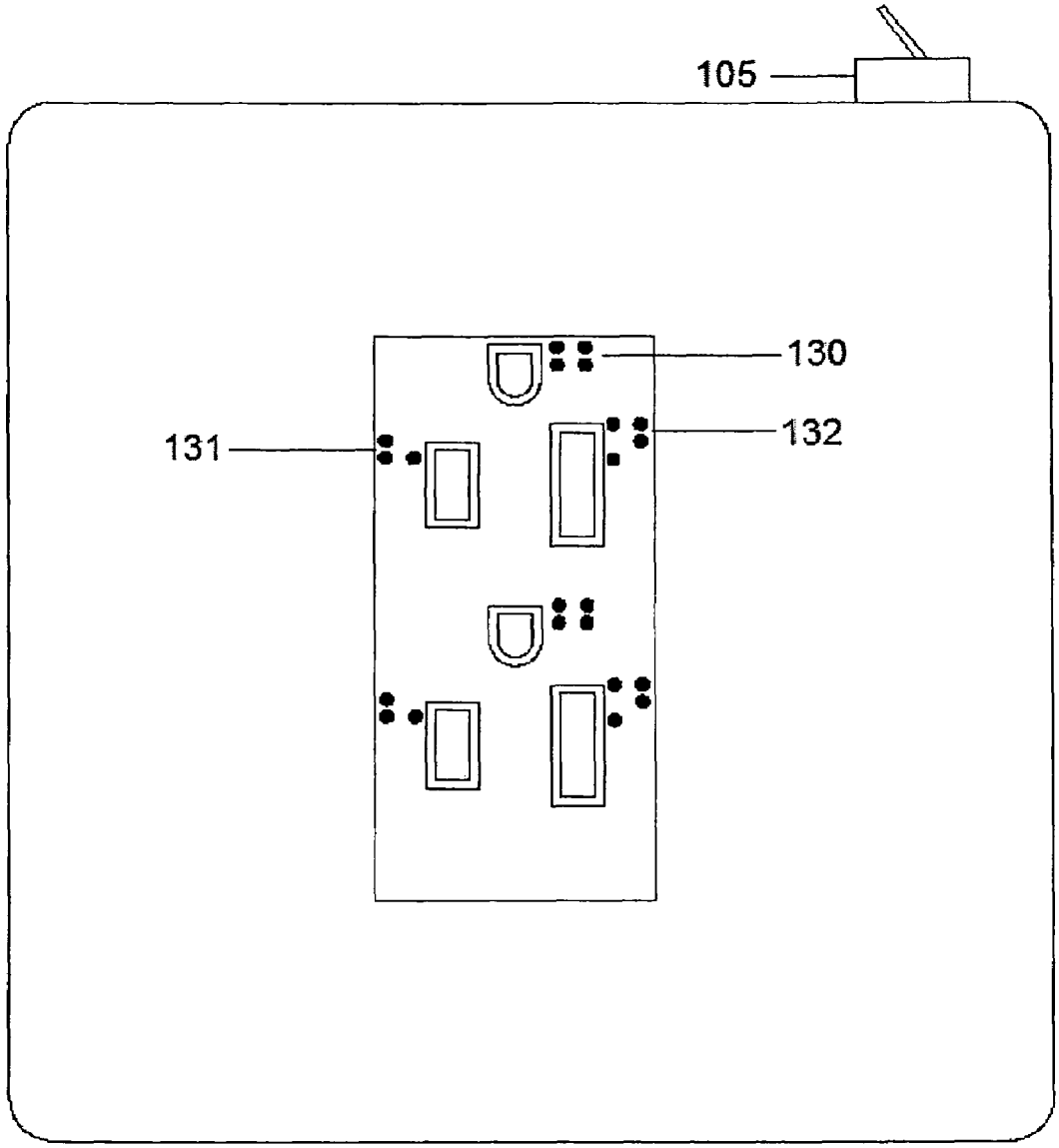
FIG. 4 is a front view of the Illuminated Power Receptacle with adjacent elevation/depression markings identifying the prong-holes. This view may be of either an external (as in FIG. 13) or internal wall receptacle.

FIG. 4 is a front view of an embodiment of the Illuminated Power Receptacle with elevation/depression markings for the prong holes. The regions 130, 131 and 132 represent the elevation/depression marking scheme for the prong-holes. This view may be of either an external (as in FIG. 13) or internal wall receptacle.

Figure 5:
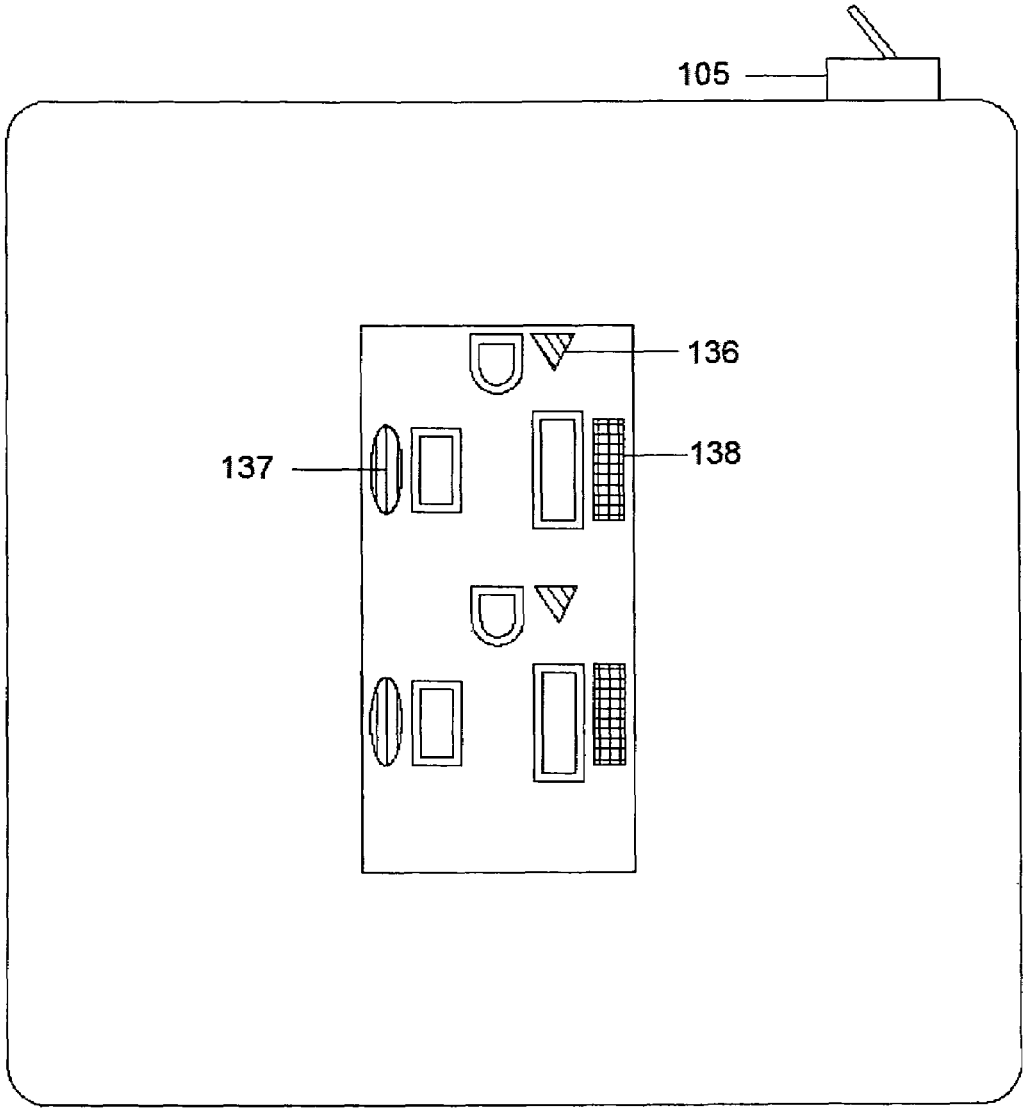
FIG. 5 is a front view of the Illuminated Power Receptacle with adjacent markings identifying the prong-holes. This view may be of either an external (as in FIG. 13) or internal wall receptacle.

FIG. 5 is a front view of an embodiment of the Illuminated Power Receptacle with adjacent markings for the prong-holes. The regions 136, 137 and 138 represent the adjacent marking scheme for the prong-holes. This view may be of either an external (as in FIG. 13) or internal wall receptacle.

Figure 6:
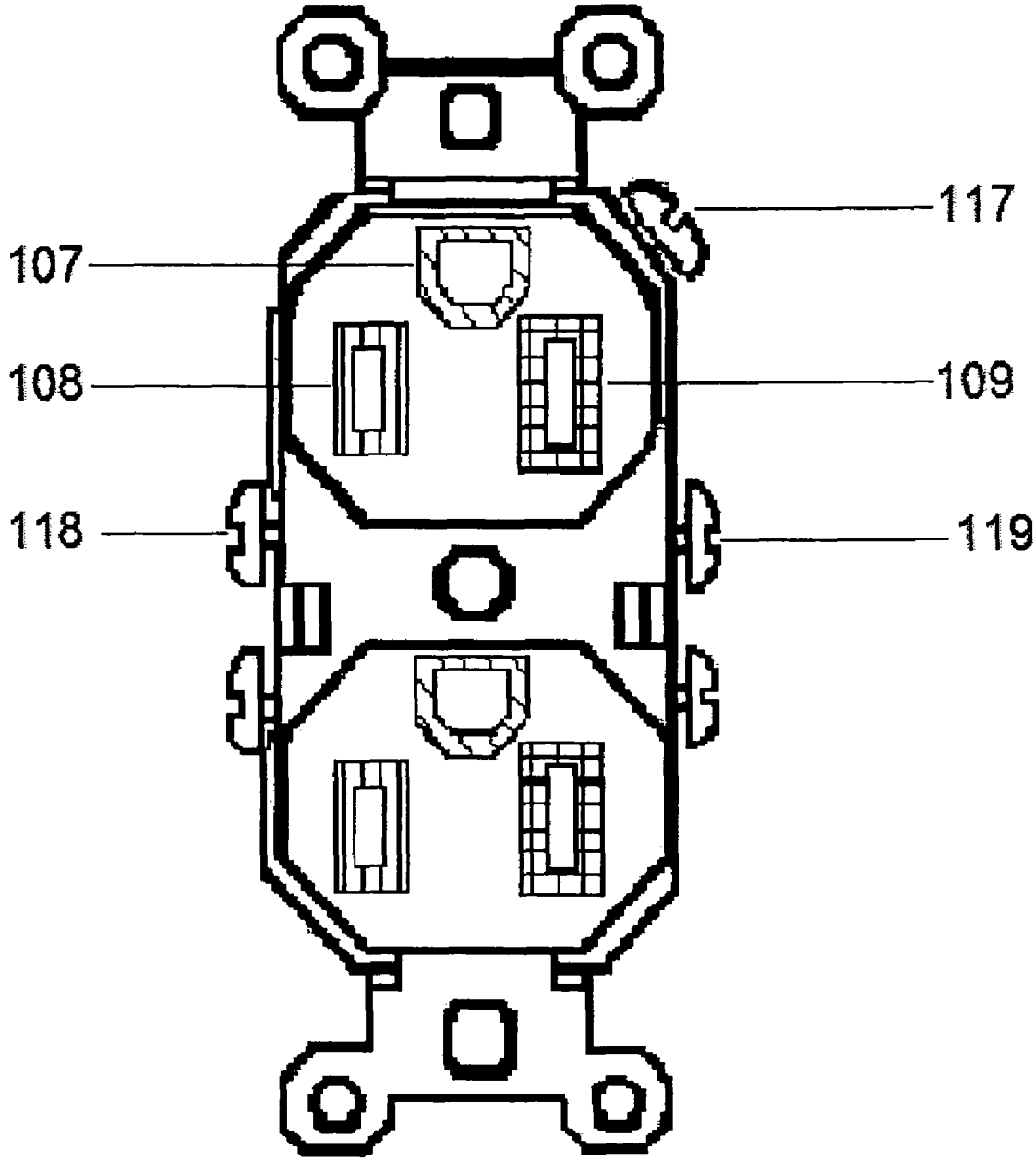
FIG. 6 is a front view of an internal duplex receptacle with surrounding color lighting identifying the prong-holes.

FIG. 6 is a front view of an internal duplex receptacle with color lighting surrounding the prong-holes. The regions 107, 108 and 109 represent the color lighting surrounding the prong-holes. The ground, hot and neutral connections to the duplex receptacle are represented by 117, 118 and 119.

Figure 7:
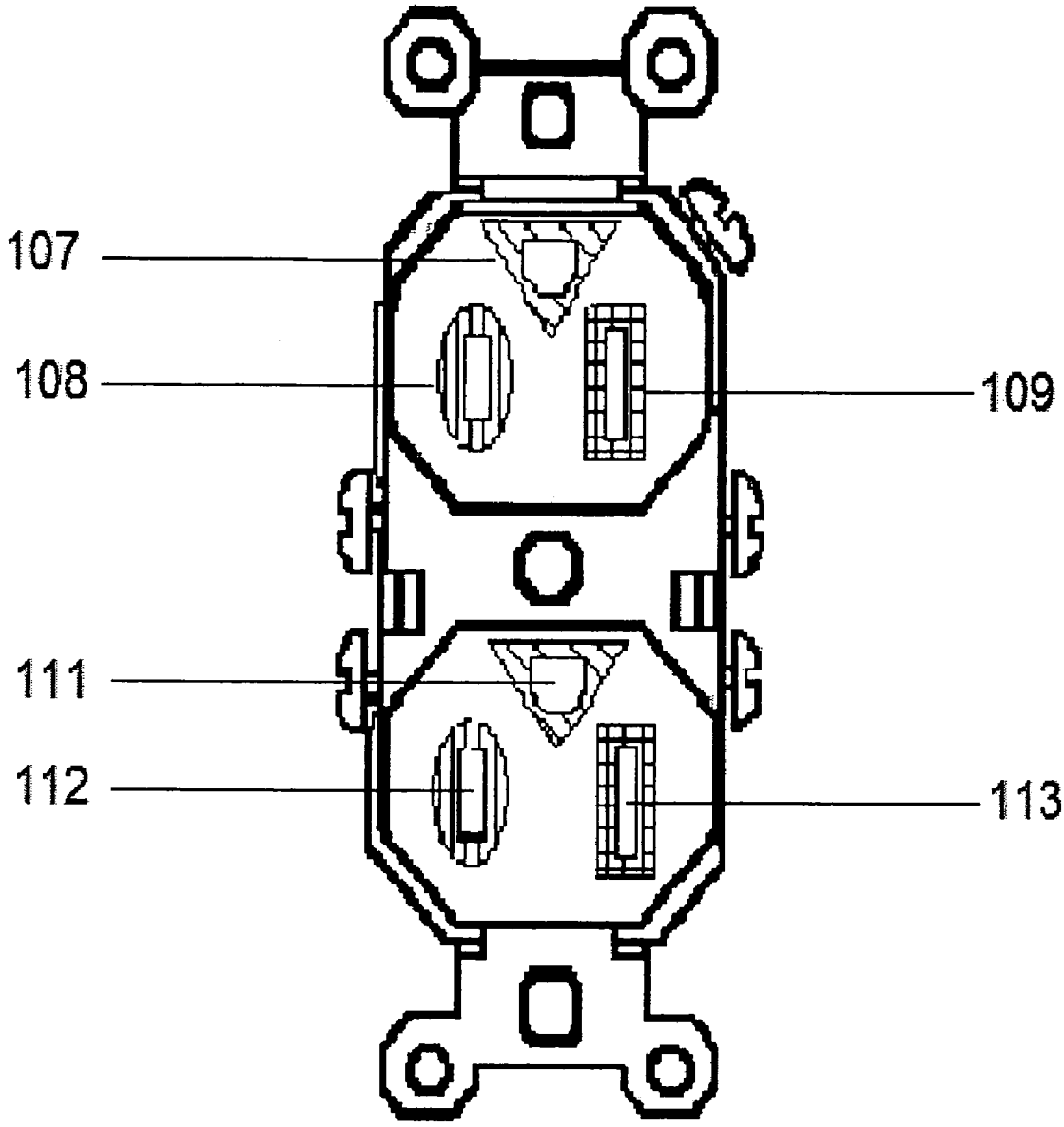
FIG. 7 is a front view of an internal duplex receptacle with surrounding color markings identifying the prong-holes.

FIG. 7 is a front view of an internal duplex receptacle with color markings surrounding the prong-holes. The regions 107, 108 and 109 represent the color markings identifying the prong-holes. The ground, hot and neutral prong holes of the duplex receptacle are represented by 111, 112 and 113.

Figure 8:
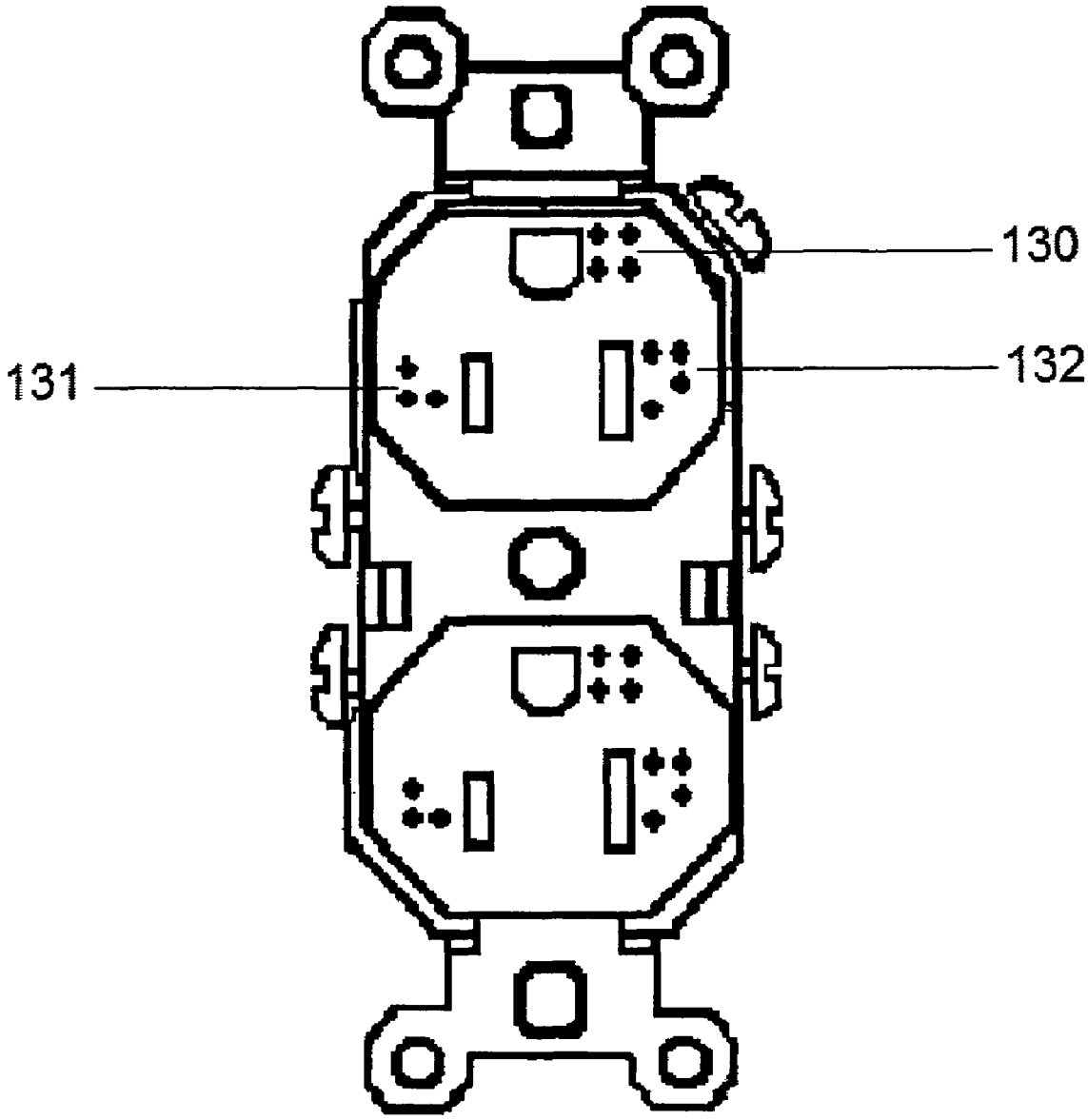
FIG. 8 is a front view of an internal duplex receptacle with adjacent elevation/depression markings identifying the prong-holes.

FIG. 8 is a front view of an internal duplex receptacle with elevation/depression markings adjacent to the prong-holes. The regions 130, 131 and 132 represent the elevation/depression marking scheme identifying the prong-holes.

Figure 9:
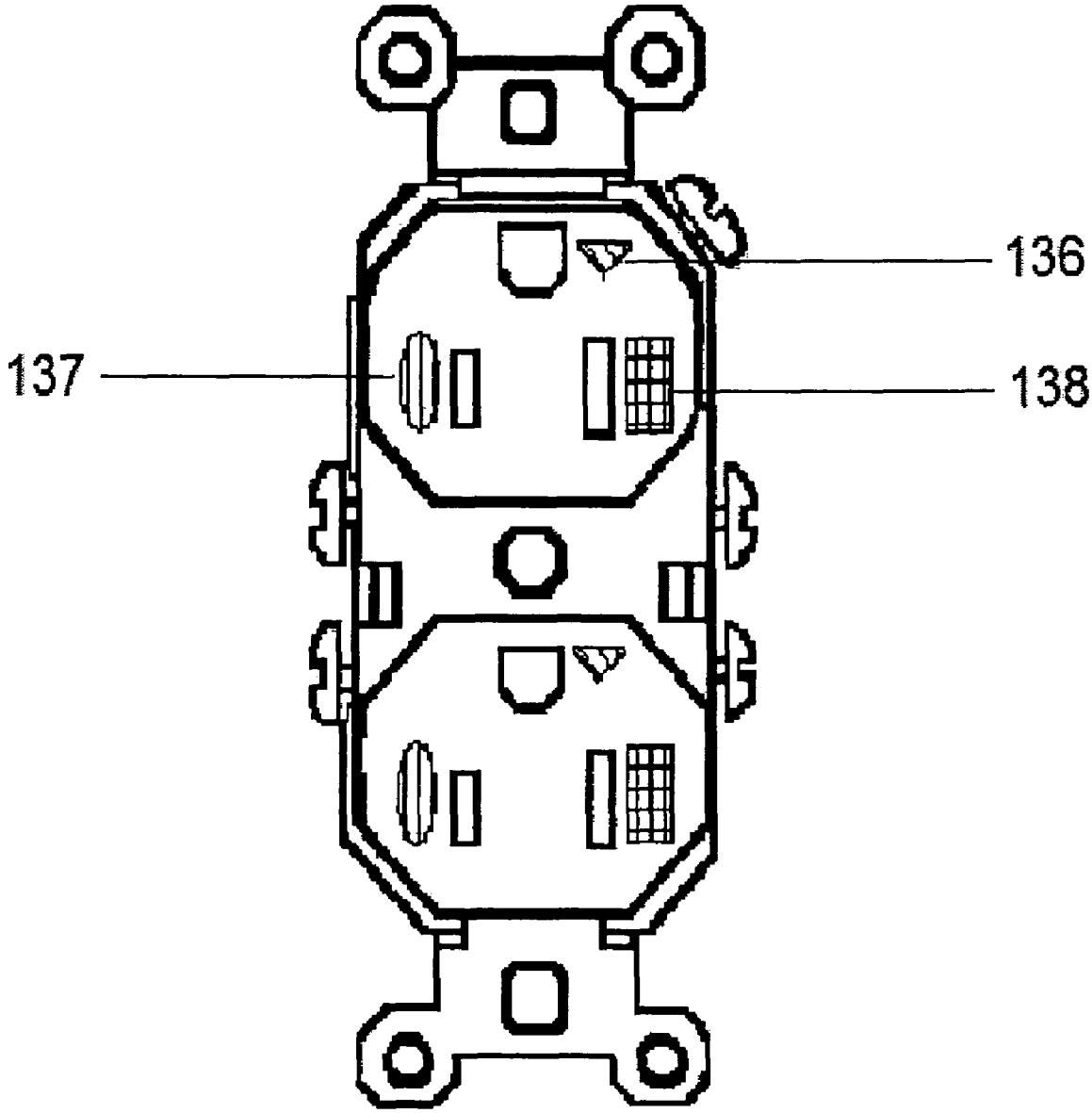
FIG. 9 is a front view of an internal duplex receptacle with adjacent markings identifying the prong-holes.

FIG. 9 is a front view of an internal duplex receptacle with markings adjacent to the prong-holes. The regions 136, 137 and 138 represent the adjacent marking scheme identifying the prong-holes.

Figure 10:
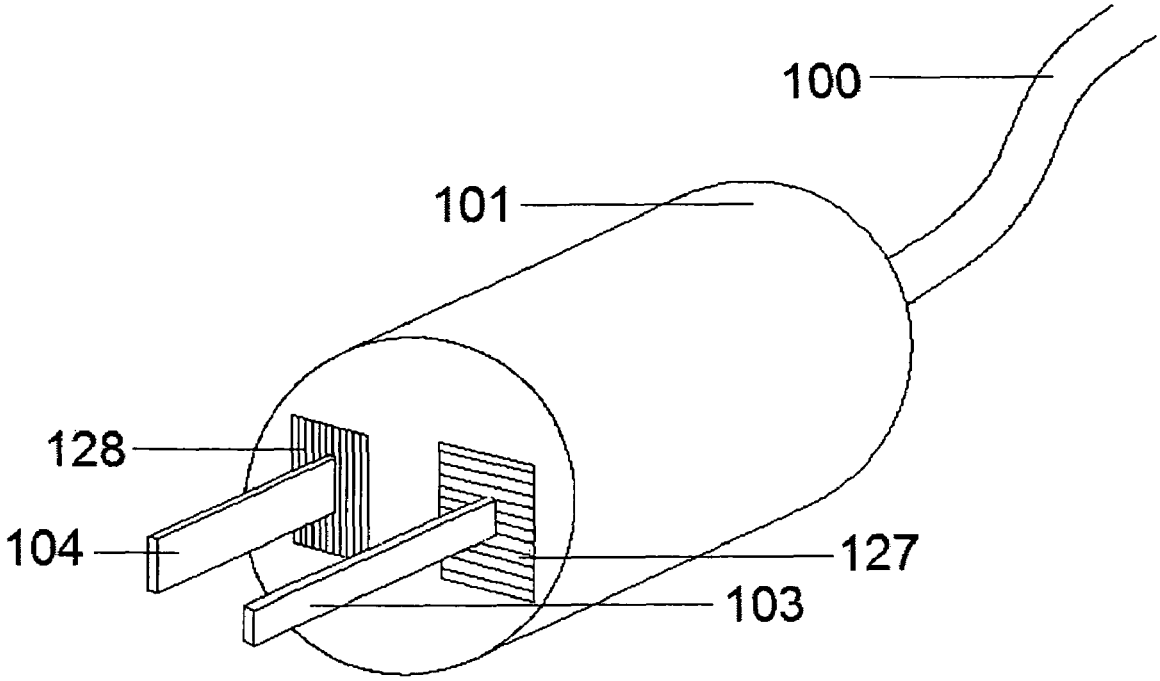
FIG. 10 is a view of a plug with color markings surrounding the prongs.

FIG. 10 is a view of a plug with color markings surrounding the prongs. The plug housing 101 with cord 100 has colored markings 127 and 128 identifying the plug prongs 103 and 104.

Figure 11:
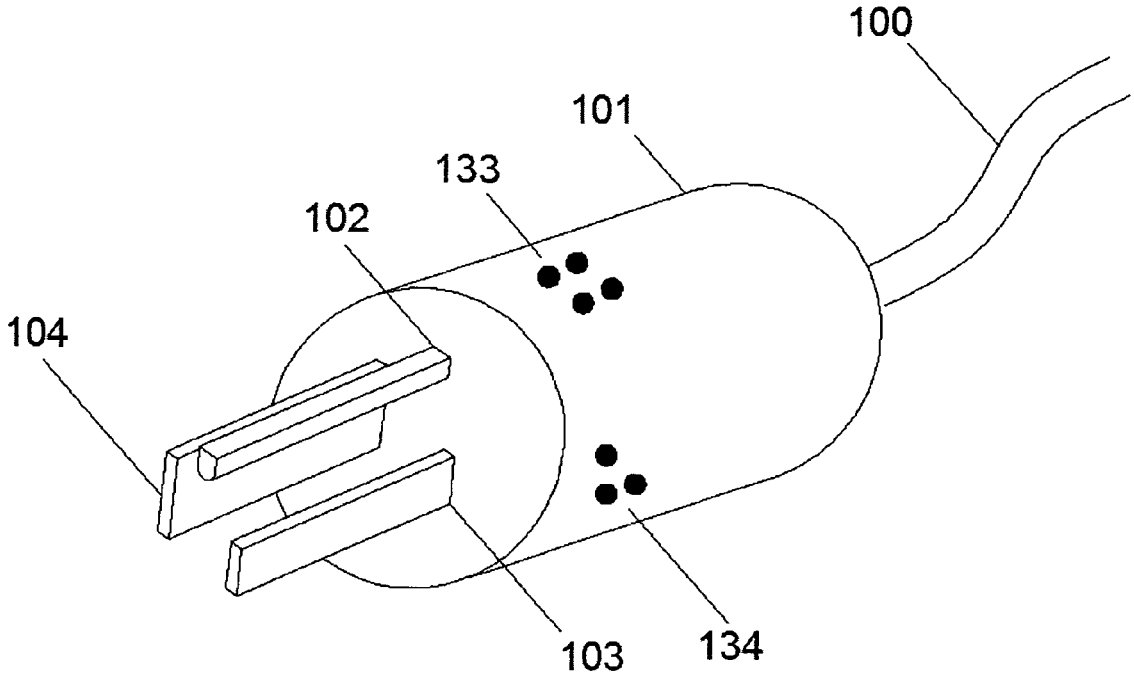
FIG. 11 is a view of a plug with elevation/depression adjacent markings identifying the prongs.

FIG. 11 is a view of a plug with elevation/depression markings adjacent to the prongs. The plug housing 101 with cord 100 has elevation/depression markings 133 and 134 identifying the plug prongs 102 and 103. The neutral prong is indicated by 104.

Figure 12:
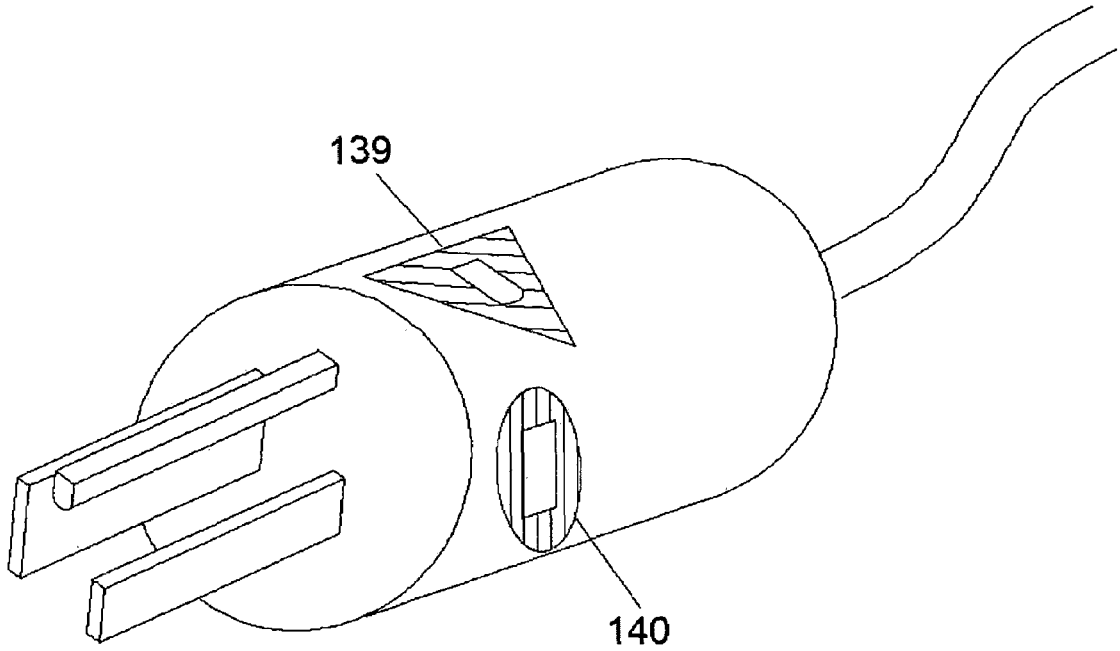
FIG. 12 is a view of a plug with adjacent color markings identifying the prongs.

FIG. 12 is a view of a plug with color markings adjacent to the prongs. Regions 139 and 140 represent adjacent color markings identifying the plug.

Figure 13:
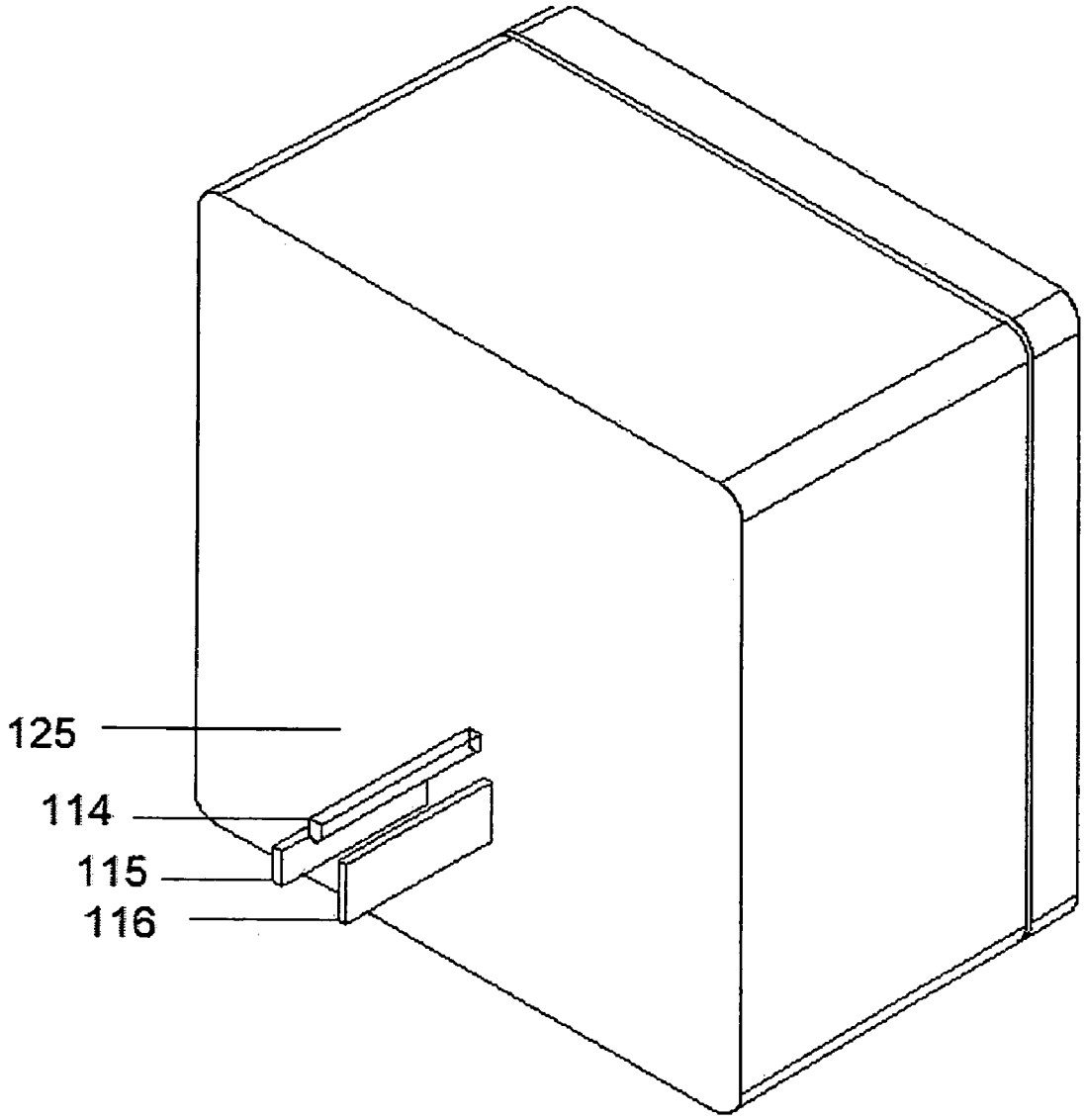
FIG. 13 is an isometric rear view of the adapter enclosure for an external receptacle.

FIG. 13 is an isometric rear view of an external receptacle adapter enclosure with a three prong plug. The prongs 114, 115 and 116 of the external receptacle enclosure 125 can be inserted into an existing wall receptacle for power supply. The face of this embodiment can be from FIGS. 2, 3, 4, 5, or 15.

Figure 14:
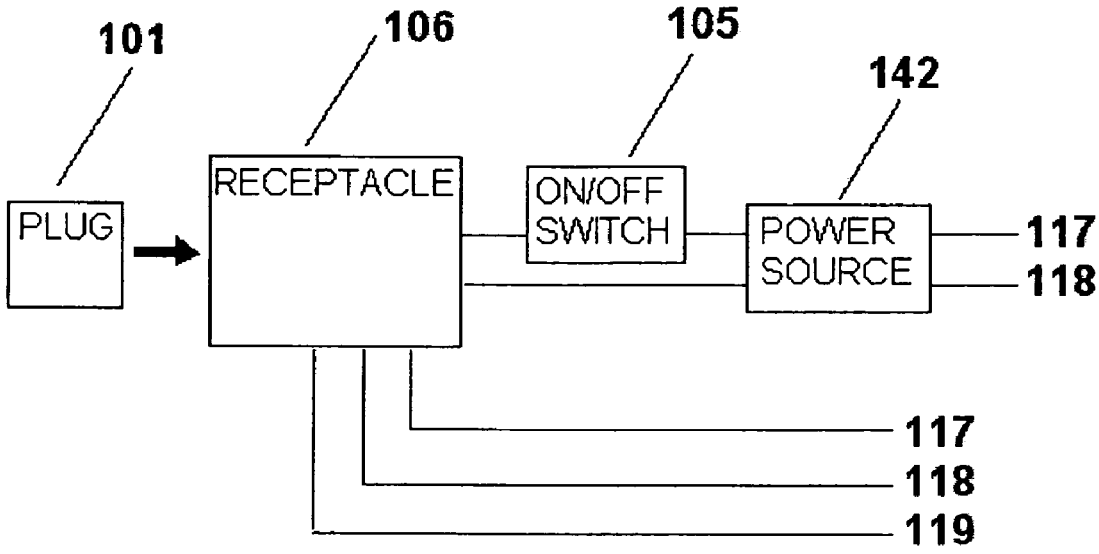
FIG. 14 is a block diagram of the illuminated power receptacle.

FIG. 14 shows a block diagram of the illuminated power receptacle. Lines 117, 118 and 119 provide power to the receptacle and the visual scheme. The power source 142 can be a DC power source or an AC power source. Switch 105 is provided to turn on or off a visual lighting scheme. The plug 101 can be interested into the receptacle 106.

Figure 15:
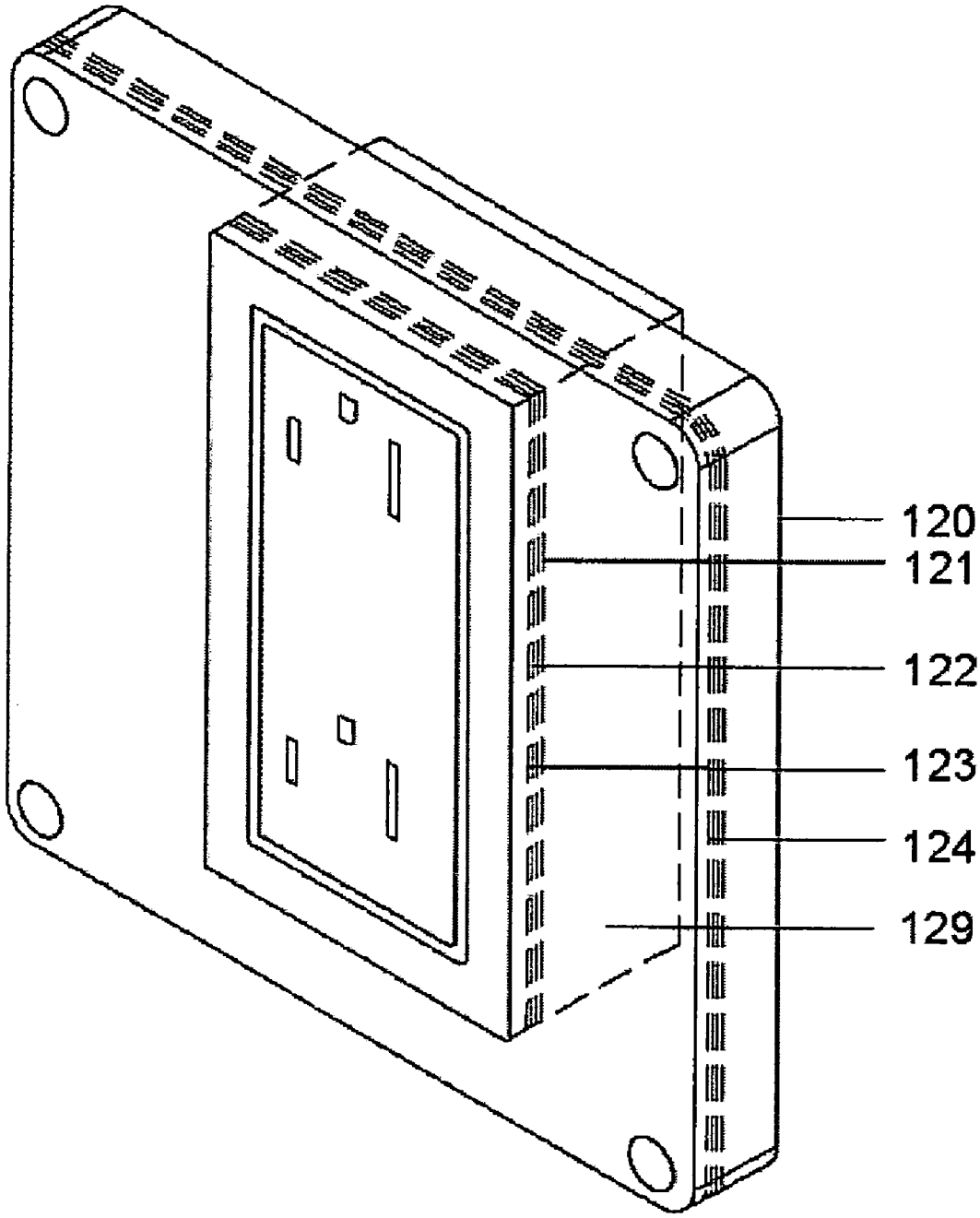
FIG. 15 is an isometric view of a back lit embodiment of the receptacle.

FIG. 15 is an isometric view of the receptacle depicting an embodiment of the illuminated Power Receptacle using a backlight and overlying filters to create colored patterns. The receptacle lid 120 houses color filters 121, 122, 123, and 124. The backlight source (not shown) is contained within the enclosure 129. Appropriate holes, not shown, can be made either surrounding or adjacent to each prong-hole and at other locations on the face to illuminate each prong-hole with a different color or color pattern.

Thus the reader will see that, according to the invention, the system described can be easily implemented into an existing home or commercial system or installed to replace such systems. This system is easily understood and is able to be used by persons of almost any age. The visual and tactile confirmations could aid all persons but especially those with impaired vision.

While the above description contains many specificities, these should not be construed as limitations on the scope of the invention, but as exemplifications of the presently preferred embodiments thereof Many other ramifications and variations are possible within teachings of the invention. For example, this system could be employed with a combination of illumination and elevation/depression markings in senior citizen homes where many residents have low vision and may find the receptacle's visual and tactical confirmation scheme helpful in decreasing frustration. Another example is to employ illuminated receptacles in a public business such as a coffee shop with custom designed markings emulating the business's logo to guide customers plugging in their electronic devices resulting in increased appreciation of the business. Another example is for the component on the cord to have prong-holes (female) and be thought of as the receptacle and the fixed component to have prongs (male) and be though of as the plug. Another example is for the power referred to in this patent to include useable information, such that the power transmitted through the plug and receptacle configuration in this patent include data or other forms of information transmission.

The receptacle described in this application can be either installed in a wall or can be produced as an adapter which can be plugged into and removed from an existing wall outlet. The external enclosure can be made of several kinds of materials, none of which, however, can be conductive. The entire system may be customized and produced in different shapes and colors.

Thus the scope of the invention should be determined by the appended claims and their legal equivalents, and not by the examples given. While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed:

1. A lighted power outlet, comprising:

a power outlet, having a front surface with one or more power receptacles;

each power receptacle having a front surface and more than one prong-hole;

each power receptacle designed to receive a single plug;

at least one light source to generate a light; and an overlying opaque plate located in at least a portion of the front surface of the power receptacle, the overlaying opaque plate having at least one translucent portion located thereto, wherein the light is transmitted from the light source and through a translucent portion of the overlying opaque plate to differentiate at least one prong-hole from the other prong-holes within the power receptacle.

2. A lighted power outlet of claim 1, wherein the translucent portion of the overlying opaque plate located in at least a portion of the front surface of the power receptacle is adjacent to at least one prong-hole.

3. A lighted power outlet of claim 1, wherein the translucent portion of the overlying opaque plate located in least a portion of the front surface of the power receptacle surrounds at least one prong-hole.

4. A lighted power outlet of claim 1, wherein the light source is electroluminescence.

5. A lighted power outlet of claim 1, wherein the light source is at least one light emitting diode (LED).

6. A lighted power outlet of claim 1, wherein the light source is at least one incandescent light.

7. A lighted power outlet of claim 1, wherein the light source is selected from the group consisting of fluorescent, neon, sodium vapor, or halogen lights.

8. A lighted power outlet of claim 1, wherein the light source is at least one electromagnetic wave source.

9. A lighted power outlet of claim 1, wherein the light is made up of at least one visible color.

10. A lighted power outlet of claim 1, wherein the light includes a plurality of colors with a different color identifying at least two different prong-holes.

11. A lighted power outlet of claim 1, wherein the light includes a plurality of colors with at least one color identifying a neutral prong-hole and at least one second color identifying a hot prong-hole.

12. A lighted power outlet of claim 1, wherein the light is displayed in at least one pattern.

13. A lighted power outlet of claim 1, wherein the light is displayed in a plurality of patterns with one pattern identifying a neutral prong-hole and a second pattern identifying a hot prong-hole.

14. A lighted power outlet of claim 1, wherein at least one light source element is powered directly from the AC power source.

15. A lighted power outlet of claim 1, wherein at least one light source element is controlled by circuitry connected between the power source and the light.

16. A lighted power outlet of claim 1, wherein the outlet is designed to be flush mounted with a surface.

17. A lighted power outlet of claim 1, wherein the outlet is in an external box which can be surface mounted onto an existing power outlet.

18. A lighted power outlet of claim 1, wherein the power supplied by the receptacle is in the form of AC electricity.

19. A lighted power outlet of claim 1, wherein the power supplied by the receptacle is in the form of DC electricity.

20. A lighted power outlet of claim 1, wherein the power supplied by the receptacle is in the form of an electromagnetic wave.

21. A lighted power outlet, comprising:

a power outlet, having a front surface with one or more power receptacles;

each power receptacle having a front surface and more than one prong-hole;

each power receptacle designed to receive a single plug;

at least one light source to generate a light; and an overlying opaque plate located in at least a portion of the front surface of the power receptacle, the overlaying opaque plate having at least one translucent portion located thereto, wherein the light is transmitted from the light source and through a translucent portion of the overlying opaque plate to differentiate at least one prong-hole from the other prong-holes within the power receptacle;

wherein the translucent portion of the overlying opaque plate interrupts the light by at least one colored translucent filter that identifies at least one prong-hole.

22. A lighted power outlet, comprising:

a power outlet, having a front surface with one or more power receptacles;

each power receptacle having a front surface and more than one prong-hole;

each power receptacle designed to receive a single plug;

at least one light source to generate a light; and an overlying opaque plate located in at least a portion of the front surface of the power receptacle, the overlaying opaque plate having at least one translucent portion located thereto, wherein the light is transmitted from the light source and through a translucent portion of the overlying opaque plate to differentiate at least one prong-hole from the other prong-holes within the power receptacle;

wherein the translucent portion of the overlying opaque plate interrupts the light by at least one patterned translucent filter that identifies at least one prong-hole.

* * * * *